United States Patent [19]

Warman

[11] Patent Number: 4,913,404

[45] Date of Patent: Apr. 3, 1990

[54] CLOSURES FOR METALLURGICAL VESSEL POURING APERTURES

[75] Inventor: Mark O. Warman, Acklam, England

[73] Assignee: British Steel Corporation, London, England

[21] Appl. No.: 313,335

[22] Filed: Feb. 21, 1989

Related U.S. Application Data

[63] Continuation of Ser. No. 101,066, Sep. 25, 1987, abandoned.

[30] Foreign Application Priority Data

Sep. 26, 1986 [GB] United Kingdom ..... 8623204

[51] Int. Cl.[4] ..... C21C 5/46

[52] U.S. Cl. ..... 266/45; 266/272; 222/597

[58] Field of Search ..... 266/45, 227, 229, 272; 222/597

[56] References Cited

U.S. PATENT DOCUMENTS

| | | | |
|---|---|---|---|
| 4,010,936 | 3/1977 | Takashima | 266/45 |
| 4,399,986 | 8/1983 | Collins | 266/45 |
| 4,471,950 | 9/1984 | LaBate | 266/272 |

FOREIGN PATENT DOCUMENTS

| | | |
|---|---|---|
| 1515629 | 6/1978 | United Kingdom . |
| 2091396 | 7/1982 | United Kingdom . |

*Primary Examiner*—S. Kastler

*Attorney, Agent, or Firm*—Kinney & Lange

[57] ABSTRACT

The invention provides a closure member for a taphole or closure of a metal and slag containing vessel comprising a plug including a temperature reactive component rapidly expandable when subjected to heat, and a component softening under the effect of heat whereby, in use, the closure member expands and fits the taphole to form a block thereto.

12 Claims, 2 Drawing Sheets

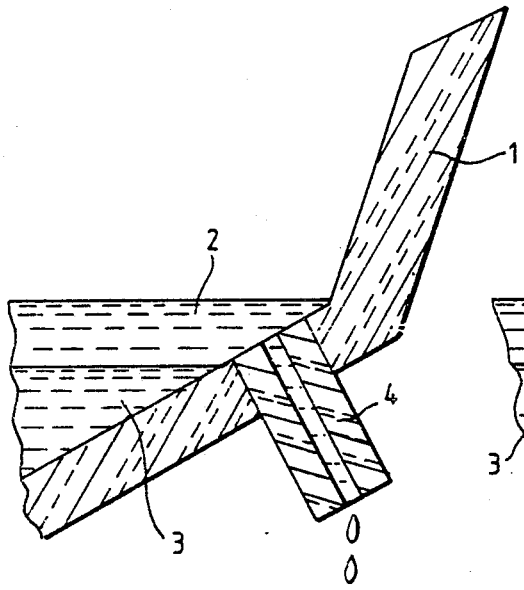
Fig.1.
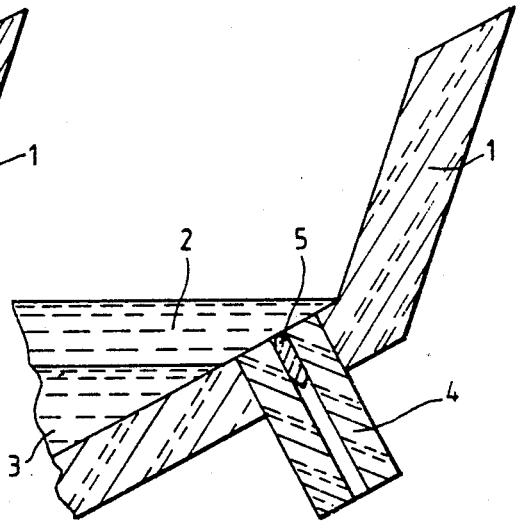
Fig.2.
Fig.3.
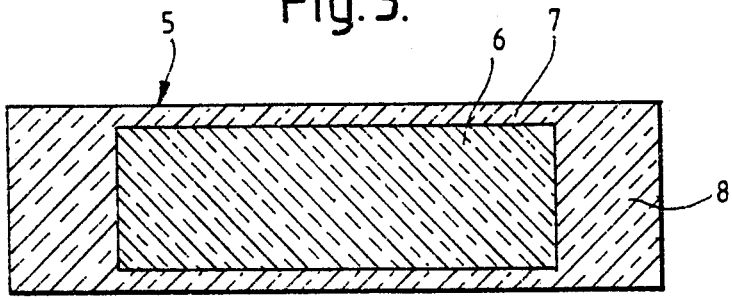

CLOSURES FOR METALLURGICAL VESSEL POURING APERTURES

This is a Continuation of application Ser. No. 101,066, filed Sept. 25, 1987 (not abandoned).

BACKGROUND OF THE INVENTION

1. Field of the Invention.

This invention relates to closures for metallurigal vessel pouring apertures and more particularly, although not exclusively, to closure members for tapholes of metal producing or processing vessels such as basic oxygen steelmaking (BOS) vessel.

2. Description of the Prior Art.

A problem in the tapping of BOS vessels, for example, is that, as the vessels are tilted towards the tapping position, an initial flow of slag will leave the vessel by the taphole, causing difficulties in disposal, prior to the metal contained in the BOS vessel being tapped into the waiting receptacle as it reaches the level of the taphole.

A number of systems has been devised in which a plugging device is inserted or fitted to the outside (cold end) of the taphole to prevent slag egress but when they are used there is a possibility that the taphole will initially fill with slag which will not be entirely displaced by metal when tapping begins.

It is an object of the present invention to overcome or at least substantially reduce the above mentioned problem.

SUMMARY OF THE INVENTION

In accordance with one aspect of the invention, there is provided a closure member for a taphole or closure of a metal and slag containing vessel comprising a plug including a temperature reactive component rapidly expandable when subjected to heat, and a component softening under the effect of heat whereby, in use, the closure member expands and fits the taphole to form a block thereto.

The closure member may be a homogeneous body carrying the two components hereinabove specified or, alternatively, may be layered or the two components otherwise segregated at least in part.

Thus, in accordance with another aspect of the invention, there is provided a closure member for a taphole or closure of a metal and slag containing vessel comprising a plug including a temperature reactive core member rapidly expandable when subjected to heat, and an outer surface layer encasing the core and being of a material softening under the effect of heat and capable of stretching to accommodate the inner expanding core.

The core may contain a component which expands and/or gives off a gas when heated such that the core then expands in a foam-like manner, and may be mixed with a component softening to form a viscous liquid, The outer layer may likewise be composed of material forming a viscous liquid when heated, and can be of the same substance as the viscous liquid form of material used in the core.

In accordance with a further aspect of the invention there is provided a method of pouring metal from a tiltable vessel containing molten metal and slag and having a taphole, comprising inserting a loosely fitting closure member as hereinbefore defined into the inner end of the taphole; allowing the closure member to heat and expand to fit tightly within the tap hole; tilting the vessel so that the slag layer moves past the taphole; and holding the vessel tilted with molten metal alongside the taphole until the metal breaks through the closure member and is poured from the taphole.

As will be appreciated, the invention enables the provision of a closure for the taphole of the vessel at its inner (hot end) to prevent slag from leaving the same prior to the tapping of metal therefrom.

BRIEF DESCRIPTION OF THE DRAWINGS

In order that the invention may be more readily understood, embodiments thereof will now be described by way of example with reference to the accompanying drawings in which:

FIG. 1 illustrates schematically, a portion of a BOS vessel in a tilted position thereof;

FIG. 2 is a schematic illustration of the vessel of FIG. 1 in the same position incorporating a closure member in accordance with the invention;

FIG. 3 is a schematic section of the closure member of FIG. 2;

DETAILED DESCRIPTION OF THE PREFERRED EMBODIMENTS

Figure 4:
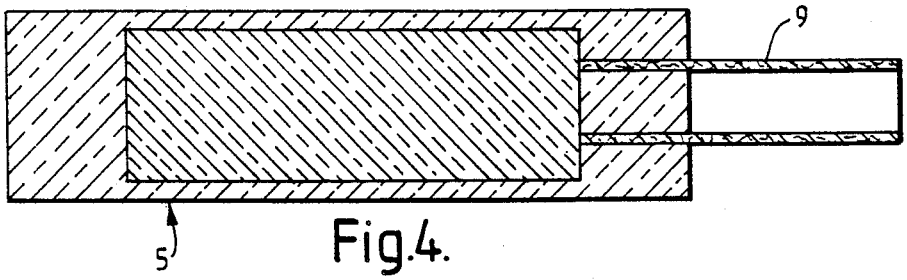
FIG. 4 is a schematic section of an alternative embodiment of closure member.

As previously mentioned, it can be seen from FIG. 1 that, as the BOS vessel 1 is tilted towards the metal tapping position, slag 2 above the molten metal 3 covers the taphole 4 from the vessel and escapes from the BOS vessel, causing considerable inconvenience in the metal receipt area below the vessel and in subsequent processing.

Again, as can clearly be seen from FIG. 2, the use of a plug 5 in accordance with the invention is a closure at the inner end of the taphole prevents the egress of slag through the taphole.

The plug 5 comprises, as previously mentioned, a core 6 containing a component that expands and/or gives off a gas when heated, and may typically be comprised of vermiculite, which is a material which exfoliates and gives off steam at temperatures above 330° C. Mixed with this particular material in the core is a second component that softens at a higher temperature (800° C. to 1000° C.) to form a viscous liquid binding the expanding vermiculite or foaming material together. The plug also comprises an outer layer 7 surrounding and encasing the core which is composed of a material that also forms a viscous liquid at 800° C. to 1000° C. This can be of the same substance as that used as a binder in the core 6.

When the plug 5 is inserted into a hot taphole in a BOS vessel, for example, the outer layer 7 of the plug softens. In addition, as heat reaches the core portion thereof, this expand and inflates the softened outer layer (or skin) 7. The delay time between insertion of the plug and expansion depends upon the thickness of the skin 7, with thinner skins giving shorter delay times. However, it is to be noted that, if the skin were too thin, heat would reach the core causing it to expand before the skin has softened which would lead to the skin flaking off and the device becoming ineffective. Clearly, therefore, adequate thickness of skin 7 is required. The softening temperature of the skin 7 can be controlled by choice of the chemical composition thereof. As can be seen in FIG. 3, the plug has a surface layer or skin which is much thicker at the ends 8 than elsewhere. This has been found to be a desirable characteristic in order to preserve the integrity of the skin. Thus, a thin skin at the ends would tend to soften and run off rapidly, leaving exposed core 6 which would then not inflate effectively.

Upon inflation of the core 6 so that it fills the taphole temporarily, slag is prevented from escaping through the tap hole 4 when the vessel 1 is tilted through contact with the slag layer 2. However, by the nature of its composition, the plug will only retain its mechanical strength for a few seconds before breaking down under the influence of the weight and heat in the steel resting upon it as the vessel is tilted beyond the slag layer to the underlying metal 3. Upon breakdown of the plug, the steel flows from the taphole into the receiving arrangement (not shown) disposed therebelow in the required manner.

A typical plug comprises a core of the order of 160 mm long×53 mm diameter coated with 6.5 mm of skin on its curved surface and 35 mm at the flat ends.

An approximate rule of thumb is that the diameter of a plug should preferably not be less than 70% of the diameter of the hole it is required to fill and the closer the diameter of the plug is to the diameter of the hole the more tightly the plug will fill the hole.

The preferred minimum diameter (d) of the plug core can be calculated form the diameter of the hole (D) by using:

$$d=(D\times 0.7)-13 \text{ (dimensions in millimeters)}$$

The length of the core (1) is calculated by $$1=d\times 3 \text{ (dimensions in millimeters)}$$

The core is then coated with skin as described above.

The skin and core binder may comprise a soda/lime/-silica mixture and sodium silicate, and typical composition of skin and core binder, which is based on powdered glass, is:

$Fe_2O_3$: 0.33%
CaO: 10.79%
$SiO_2$: 72.72%
MgO: 0.60%
$Al_2O_3$: 1.90%
$K_2O$: 0.85%
$Na_2O$: 12.81%

For some applications where longer delay times are required or when the taphole is particularly hot, the softening temperature of the skin and core binder can be increased by the use of additives, for example magnesia (MgO), to the mix at concentrations of up to or beyond 50% weight. The skin in this case may remain brittle to higher temperatures and it may be necessary to increase the thickness of the skin to prevent heat reaching the core and starting inflation before the skin softens.

It will be appreciated that the life of the plug, and its inflation time (delay times) can be varied by the incorporation of materials of different levels of conductivity, such as materials of high conductivity, in the mixes both for the core 6 and for the surface layer 7. Thus additions of carbonaceous materials such as electrocalcined anthracite, electrocalcined graphite, and natural flake graphite to the skin and core can be used to decrease reaction times. It is also possible to make use of an outer layer of material (for example magnesia) of a chemical composition so chosen as to minimise any reaction between the component materials of the plug and the taphole refractories.

To assist in placing the plug 5 in the correct position in the taphole 4 the plug can incorporate a device such as a thick cardboard tube 9 as seen in FIG. 4. This enables the plug 5 to be slipped onto the end of a pole (not shown) so that it can be pushed into position. When the plug is in place the outermost layer of the skin 7 softens almost immediately and makes the plug adhere to the inside of the taphole 4 and the pole can be withdrawn.

Figures 5A, 5B, 6:
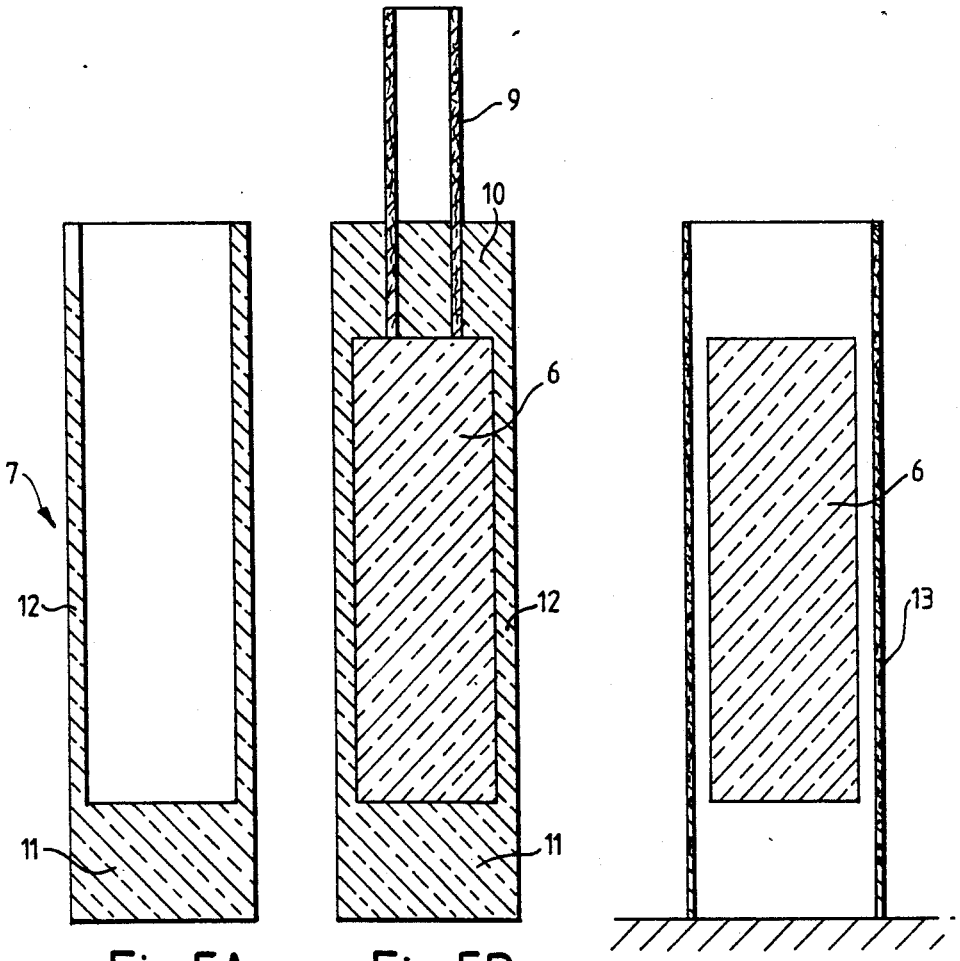
FIGS. 5A and 5B are schematic representations of one arrangement for forming a closure member.
FIG. 6 is a schematic representation of an alternative arrangement for forming a closure member.

Various procedures can be used to manufacture the plug. As seen in FIGS. 5A and 5B one method is to press the mix to make a solid end 11 and shell 12 of skin material which is subsequently filled with core mix 6 and topped off with a thick end skin 10 and fitted with a thick cardboard tube 9. A second method as seen in FIG. 6 is to press the core 6 and when it has hardened place it centrally in a thin cardboard tube 13 which acts as an outer mould which is then filled with the skin material and a thick cardboard tube fitted as with FIG. 5B (not shown). When the plug has solidified the thin cardboard outer tube 13 can be peeled off or the plug used with the thin cardboard remaining. In this case there would be little adhesion between plug and taphole 4 when it is first inserted and there may be some delay before inflation begins as the cardboard burns. As an alternative the thin cardboard tube 13 that acts as the outer mould can be replaced by a plastic tube which need not be removed after manufacture and which breaks down very rapidly when subjected to heat.

I claim:

1. A closure member for a taphole or closure of a metal and slag containing vessel comprising a plug including a temperature reactive core swelling rapidly when subject to heat above approximately 330° C., and a skin wholly enveloping the core and being of a material softening under the effect of the heat within the range of approximately 800°-1000° C. and capable of stretching to accommodate the inner swelling core, whereby, in use, the closure member fits loosely into the taphole of a metal and slag containing vessel when initially inserted, thereby allowing placement of the closure member at any point along the inner length of the taphole, expands to fit the taphole upon exposure to heat to form a block thereto, said block resulting from the pressure exerted by said expanded closure member on the inner surface of said taphole.

2. A closure member as claimed in claim 1 wherein a component only of the core swells when heated.

3. A closure member as claimed in claim 1 wherein the core contains a component which gives off a gas when heated such that the core swells in a foaming manner.

4. A closure member as claimed in claim 1 wherein the core includes a component softening when heated within the range of approximately 800°-1000° C. to form a viscous liquid.

5. A closure member as claimed in claim 1 wherein the skin is composed of material forming a viscous liquid when heated within the range of approximately 800°-1000° C.

6. A closure member as claimed in claim 1 wherein the core includes vermiculite.

7. A closure member for a taphole or closure of a metal and slag containing vessel comprising a plug including a temperature reactive core swelling rapidly when subject to heat above approximately 330° C., and a skin wholly enveloping the core and being of a material softening under the effect of the heat within the range of approximately 800°-1000° C. and capable of stretching to accommodate the inner swelling core with the core containing and the skin being composed of soda/lime/silica mixture and sodium silicate, whereby, in use, the closure member fits loosely into the taphole of a metal and slag containing vessel when initially inserted, thereby allowing placement of the closure member at any point along the inner length of the taphole, expands to fit the taphole upon exposure to heat to form a block thereto, said block resulting from the pressure exerted by said expanded closure member on the inner surface of said taphole.

8. A closure member as claimed in claim 1 wherein the core and the skin contains magnesia.

9. A closure member as claimed in claim 1 wherein the plug is in the form of a parallel sided cylinder.

10. A method of pouring metal from a tiltable vessel containing molten metal with a slag layer thereon and having a taphole, comprising the steps of:

inserting into an inner end of the taphole a loosely fitting closure member which includes a temperature reactive core swelling rapidly when subject to heat above approximately 330° C. and an outer surface layer encasing the core of a material that softens when subjected to heat within the range of approximately 800°-1000° C.;

allowing the closure member to heat and expand to fit tightly within the taphole proximate the inner end thereof;

tilting the vessel so that the slag layer moves past the taphole; and holding the vessel tilted with molten metal alongside the taphole until the metal breaks through the closure member and is poured from the taphole.

11. A method as claimed in claim 10 wherein the closure member when fitted into the taphole has a diameter not less than 70% of the diameter of the taphole, but in no instance is the closure member diameter as large as the taphole diameter until after expansion.

12. A closure member for a taphole of closure of a metal and slag containing vessel wherein the taphole or closure has a first lateral width, the closure member comprising plug including a temperature reactive core swelling rapidly when subject to heat above approximately 330° C., and a skin wholly enveloping the core and being of a material softening under the effect of the heat within the range of approximately 800°-1000° C. and capable of stretching to accommodate the inner swelling core, with the plug, in its unheated state, having a width of not less than 70% of the first width of taphole or closure of the vessel whereby, in use, the closure member fits loosely into the taphole of a metal and slag containing vessel when initially inserted, thereby allowing placement of the closure member at any point along the inner length of the taphole, expands to fill the entire first width of the taphole upon exposure to heat of form a block thereto, said block resulting from pressure exerted by side expanded closure member on the inner surface of said taphole.

* * * * *